US006336464B1

(12) United States Patent
Ko

(10) Patent No.: US 6,336,464 B1
(45) Date of Patent: Jan. 8, 2002

(54) STRETCHER STRUCTURE USED FOR COLLAPSIBLE TWO-LAYER CANOPY WIND RESISTANT UMBRELLAS

(76) Inventor: Chin Sung Ko, No. 27-1, Lane 188, Sec. 3, Chin Mar Road, Changhua City (TW)

( * ) Notice: Subject to any disclaimer, the term of this patent is extended or adjusted under 35 U.S.C. 154(b) by 0 days.

(21) Appl. No.: 09/643,935

(22) Filed: Aug. 23, 2000

(51) Int. Cl.[7] ..... A45B 25/22

(52) U.S. Cl. ..... 135/29; 135/30; 135/25.31; 135/33.7

(58) Field of Search ..... 135/29, 30, 32, 135/31, 25.31, 33.7

(56) References Cited

U.S. PATENT DOCUMENTS 2,076,525 A * 4/1937 Bouma ..... 135/31 X
5,305,770 A * 4/1994 DeMarco ..... 135/26
5,435,331 A * 7/1995 Okuda ..... 135/29
5,597,004 A * 1/1997 Okuda ..... 135/29
6,024,109 A * 2/2000 Lin et al. ..... 135/33.7
6,039,063 A * 3/2000 Lin et al. ..... 135/33.7
6,095,171 A * 8/2000 Lin et al. ..... 135/33.7
6,164,303 A * 12/2000 Lin et al. ..... 135/29
6,173,723 B1 * 1/2001 Wang ..... 135/31

* cited by examiner

*Primary Examiner*—Beth A. Stephan
*Assistant Examiner*—Phi Dieu Tran A
(74) *Attorney, Agent, or Firm*—Rosenberg, Klein & Lee

(57) ABSTRACT

An innovative stretcher structure used for collapsible two-layer canopy wind resistant umbrellas primarily uses a connection block in conjunction with two staggered curved portions each formed on a main tail plate and a secondary tail plate to enhance the wind resistant strength of an umbrella. When wind blows the umbrella, a stretcher according to the invention not only supports the umbrella canopy to endure wind but also provides a restoring force to counteract the overturning force exerted on the umbrella stretcher system by wind. Thus the present invention has an enhanced wind resistant strength.

4 Claims, 8 Drawing Sheets

STRETCHER STRUCTURE USED FOR COLLAPSIBLE TWO-LAYER CANOPY WIND RESISTANT UMBRELLAS

BACKGROUND OF THE INVENTION

For average collapsible two-layer canopy wind resistant umbrellas shown in FIGS. 1 through 3 it is principally constructed by linking a pivoting element (a) of a main umbrella stretcher with a connection element (b) that accommodates a tail plate (c) to form a support stretcher. Such a structure only utilizes a combination between the connection element (b) and the tail plate (c) to withstand wind force. When wind blows, the tail plate (c) is lifted. The stretcher is easy to be bent or even broken because the force is exerted on the joint between the connection element (b) and the tail plate (c). In addition, the linkage between the tail plate (c) and the connection element (b) is only achieved by an obliquely projecting tab (d) and thus the connection is vulnerable and easy to be broken.

In view of the above-mentioned problems, the object of the invention is to provide an innovational stretcher structure used in collapsible two-layer canopy wind resistant umbrellas that has multiple support points to resist wind forces and provide effective restoring forces to prevent canopies and stretchers from being overturned or damaged. Now the features and structure of the present invention will be described in detail with reference to the concomitant drawings.

BRIEF DESCRIPTION OF ACCOMPANYING DRAWINGS

DETAILED DESCRIPTION OF THE INVENTION

Figure 1:
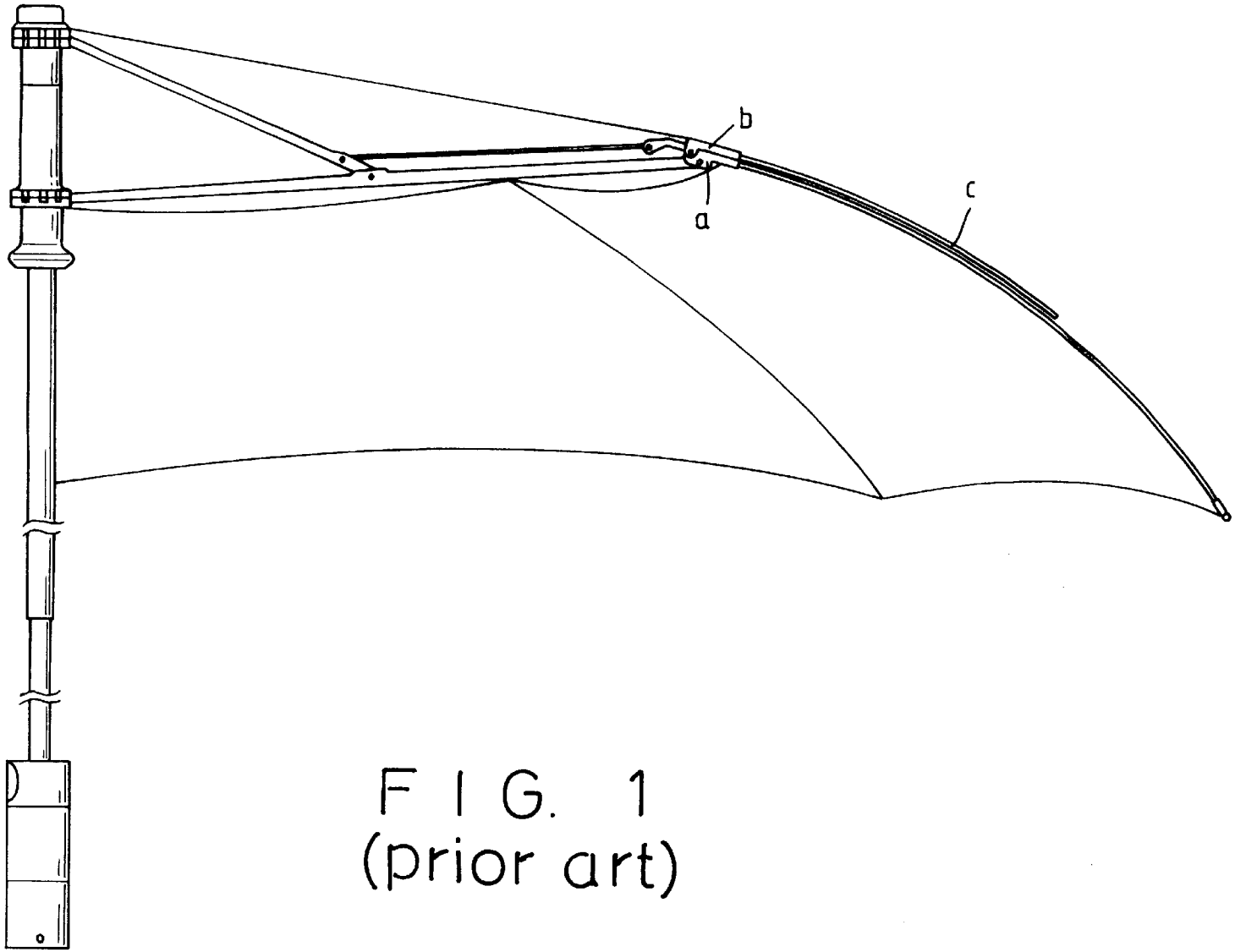
FIG. 1 (prior art)
FIG. 1 is a schematic plan view showing a collapsible two-layer wind resistant umbrella according to a prior art.
Figure 2:
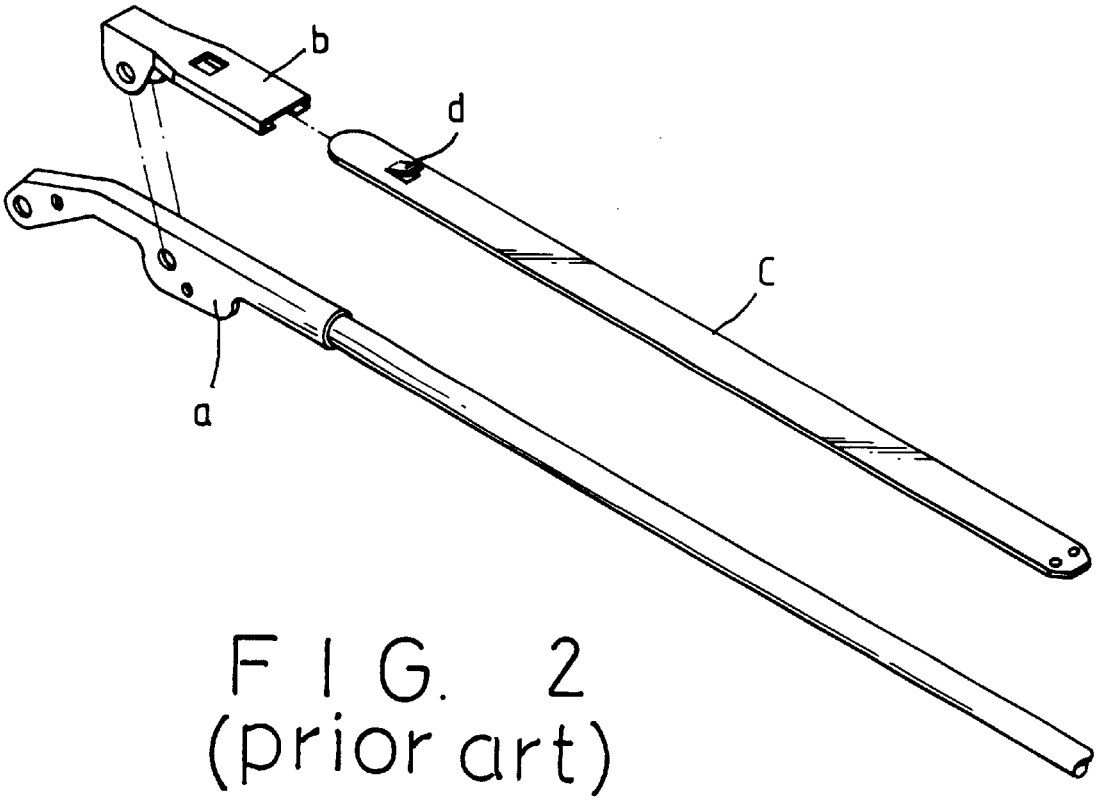
FIG. 2 (prior art)
FIG. 2 is an exploded view depicting the main tail plate structure of a stretcher of the umbrella shown in FIG. 1.
Figure 3:
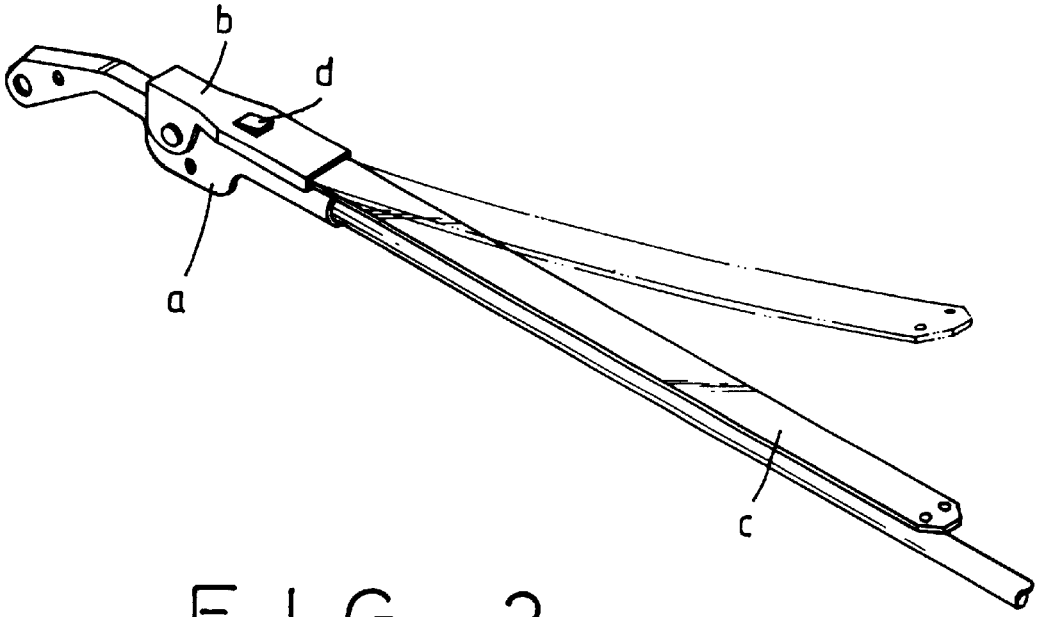
FIG. 3 (prior art)
FIG. 3 is a perspective view showing the stretcher of FIG. 2 in an assembled state.
Figure 4:
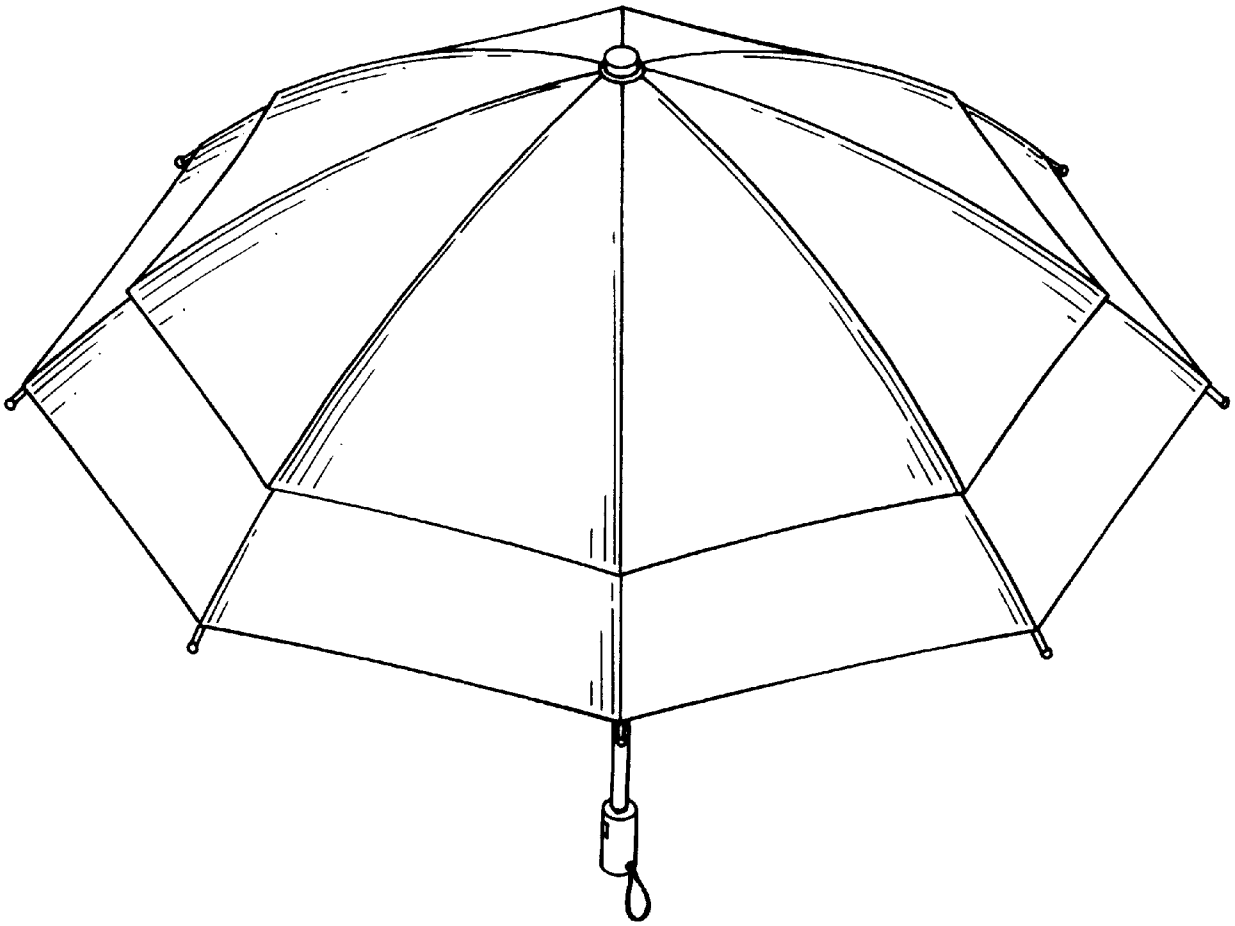
FIG. 4 shows the outer appearance of an umbrella according to the invention.
Figure 5:
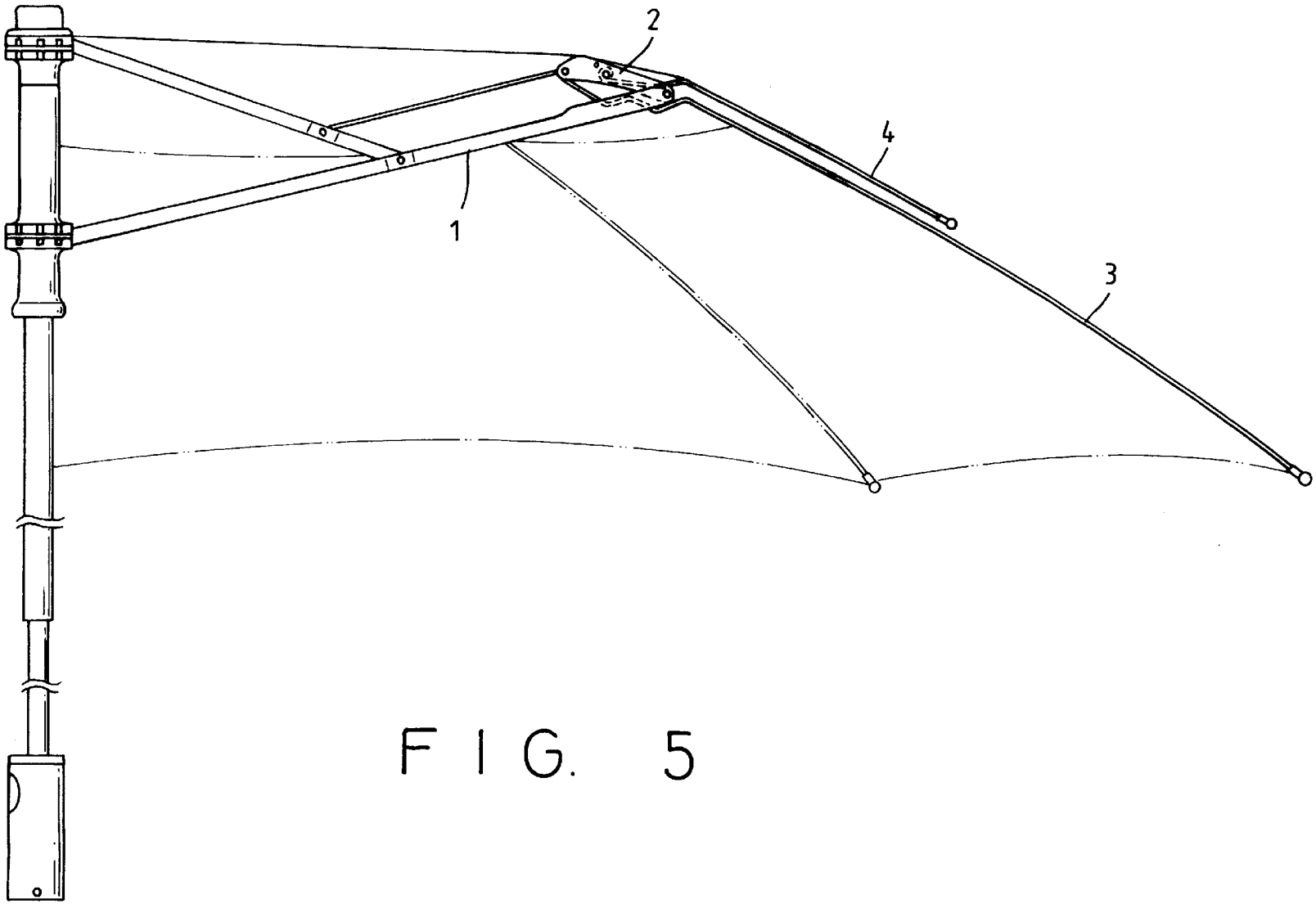
FIG. 5 is a schematic plan view indicating the structure of the umbrella shown in FIG. 4.
Figure 6:
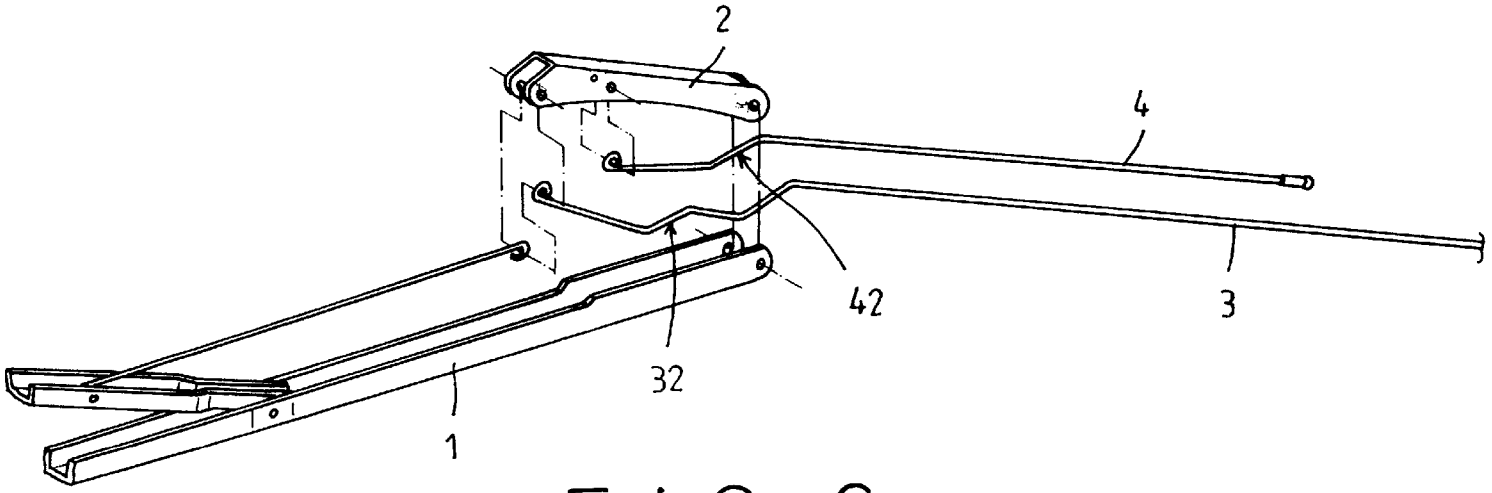
FIG. 6 is an explode view illustrating the structure of a tail plate of the umbrella shown in FIG. 5.
Figure 7:
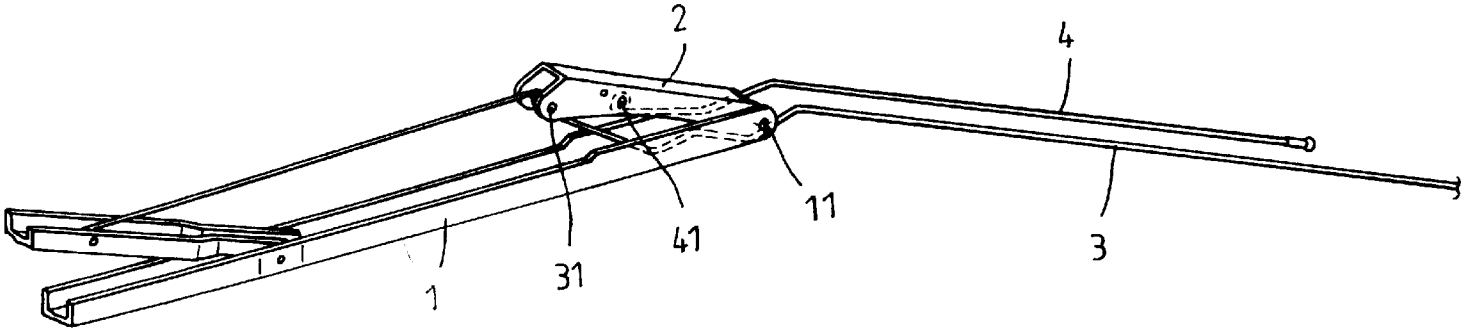
FIG. 7 is an assembly drawing of the tail plate shown in FIG. 6.
Figure 8:
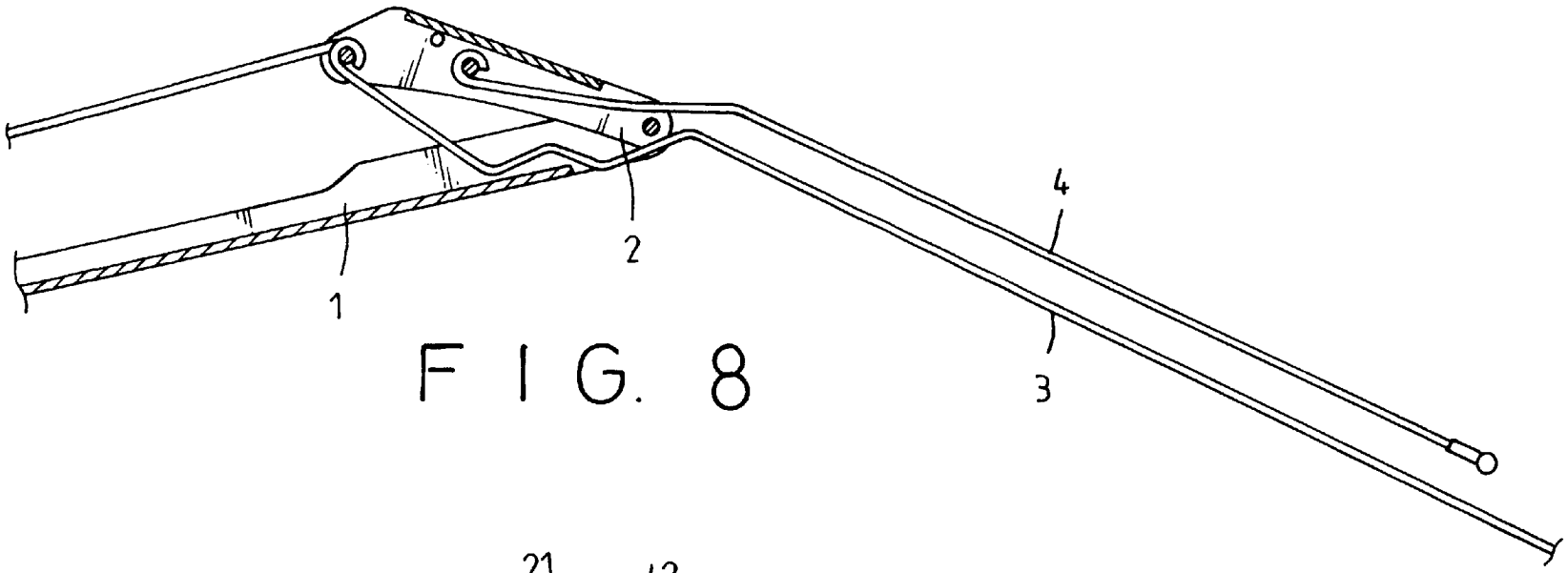
FIG. 8 is a cross sectional view of the tail plate shown in FIG. 7.

As shown in FIG. 4, the invention is an umbrella stretcher structure used in a collapsible two-layer canopy wind resistant umbrella. The main feature of the umbrella stretcher according to the invention consists in the structural design of tail plates. Referring to FIGS. 5 through 8, the umbrella stretcher structure comprises a main stretcher (1), a main tail plate (3) and a secondary tail plate (4). The main stretcher (1) is pivotally linked on the outer end thereof to the outer end of a connection block (2) through a first pivotal pin (11). The main tail plate (3) is provided near the inner end with a staggered bent portion (32), which extends under the first pivotal pin (11), with the inner end thereof coupled with a second pivotal pin (31) located on the inner end of the connection block (2). Furthermore, the secondary tail plate (4) is similarly provided on the inner end with a staggered bent portion (42) that extends above the first pivotal pin (11) with the inner end secured to a third pivotal pin (41) located in the middle section of the connection block (2). With such an arrangement an umbrella stretcher according to the invention is completed.

Figure 9:
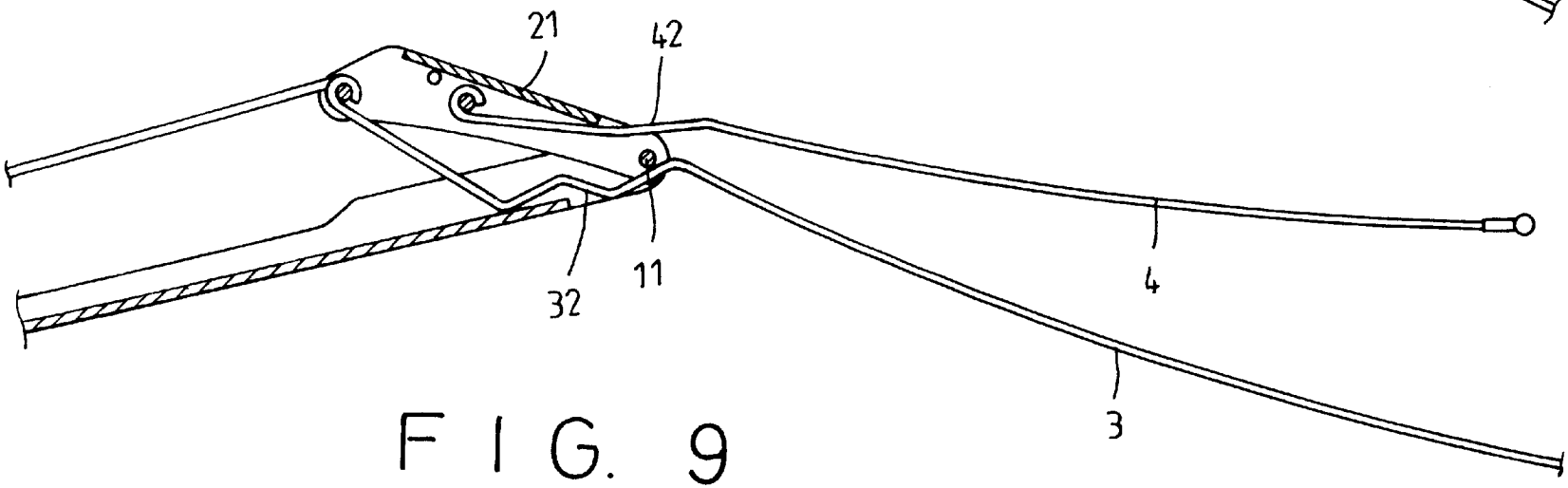
FIG. 9 illustrates the movements of the tail plates shown in FIG. 8.

When an umbrella having the stretchers according to the invention encounters strong winds, its main tail plate (3) and the secondary tail plate (4) will be slightly lifted as shown in FIG. 9. At that time the main tail plate (3) presses against the first pivotal pin (11). Under the influence of reaction force, the staggered bent portion (32) of the main tail plate (3) is downwardly urged to pull the main stretcher (1) downwardly. As a result, it develops a general resistant force against the force of overturning the umbrella canopy. Furthermore, the second pivotal pin (31) is also driven downwardly, which brings the connection block (2) to swing downwardly. Consequently the connection block (2) depresses the secondary tail plate (4) by an extension portion (21) formed on the top of the connection block (2), providing an enhanced restoring force. The provision of the staggered bent portion of the main tail plate and of the secondary tail plate enables the main tail plate and the secondary tail plate to be able to endure more deflection forces with damage or fracture. Therefore, the invention promotes the function and practical value of a collapsible two-layer canopy wind resistant umbrella.

Figure 10:
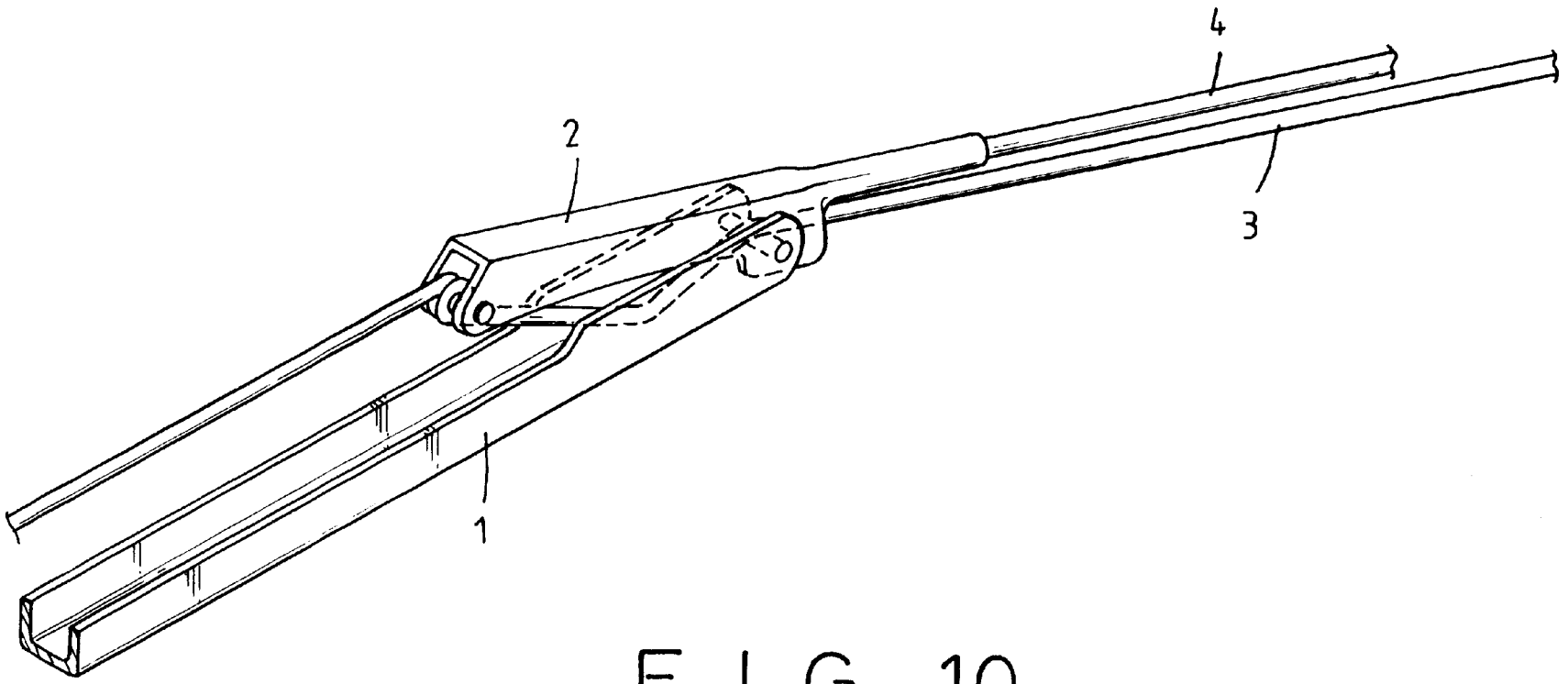
FIG. 10 shows a variant of the stretcher structure according to the invention.
Figure 11:
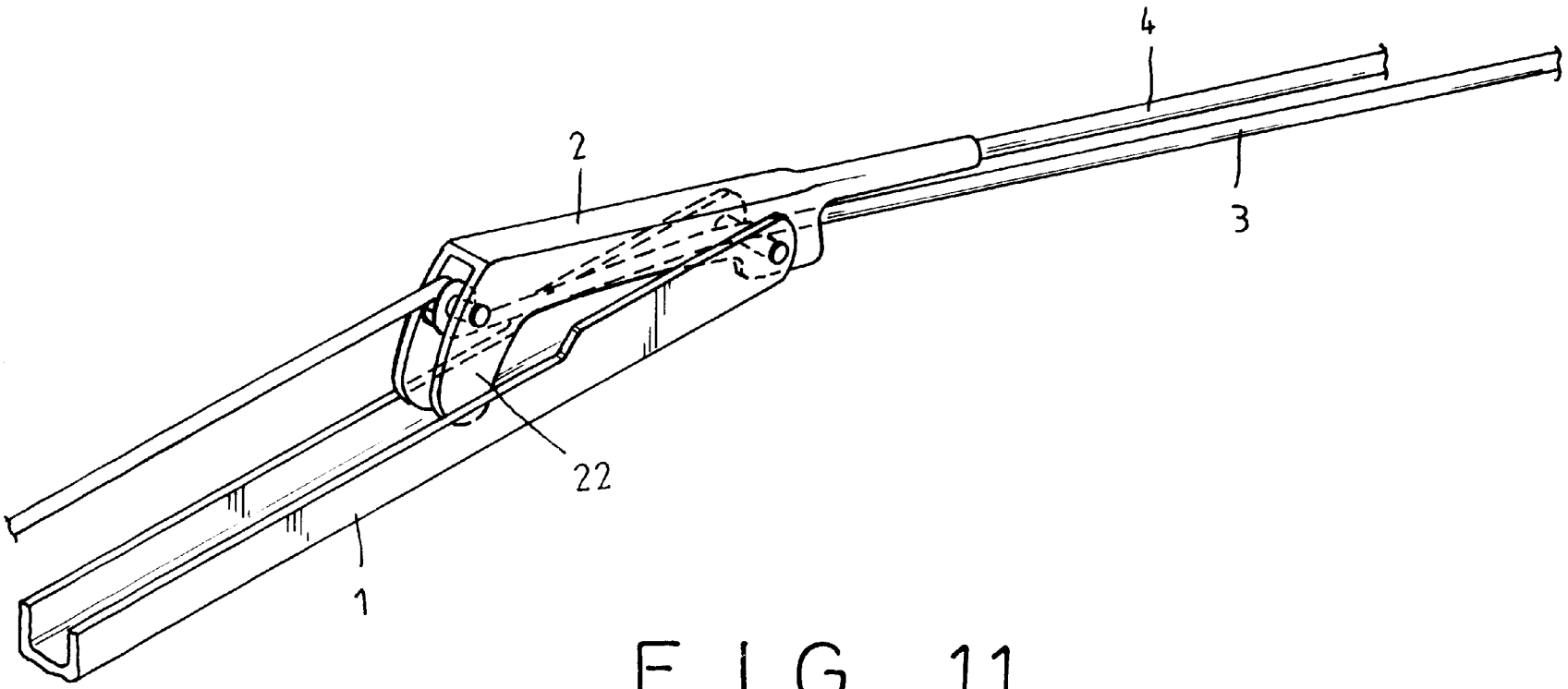
FIG. 11 depicts another variant of the stretcher structure according to the invention.

FIG. 10 shows a variant of the stretcher structure according to the invention. In this case, the connection block (2) is configured to have such a tubular tail end that it can receive and hold the secondary tail plate (4) in position. In FIG. 11, another variant of the stretcher structure according to the invention is shown. The connection block (2) shown in FIG. 11 is provided on the inner end with a downwardly extending portion (22) that presses against the main stretcher (1) to provide effective restoring forces when the umbrella endures wind blowing. It can also achieve the object set forth in the beginning of the text.

In summary, the invention indeed has the essence of a patent and thus we apply for a patent grant.

What is claimed is:

1. A stretcher structure used in collapsible two-layer canopy wind resistant umbrellas primarily comprising a main stretcher, a main tail plate and a secondary tail plate each associated with a canopy to form a two-layer canopy wind resistant umbrella, and characterized in that said main stretcher is pivotally linked on the outer end thereof to the outer end of a connection block through a first pivotal pin; said main tail plate is provided near an inner end thereof with a staggered bent portion that is routed under said first pivotal pin and is coupled on the inner end thereof with a second pivotal pin located on the inner end of said connection block; and said secondary tail plate is provided on an inner end thereof with a staggered bent portion that extends above said first pivotal pin with the inner end thereof secured to a third pivotal pin located in the middle section of said connection block.

2. The stretcher structure as claimed in claim 1 wherein said main tail plate and said secondary tail plate will slightly swing up when wind blows the umbrella, as a result of which said main tail plate presses against said first pivotal pin, the staggered bent portion of said main tail plate is urged by the reaction force to downwardly pull said main stretcher and thereby to provide a downward restoring force, and said second pivotal pin is also moved downwardly to drive said connection block downwardly; said connection block further depressing the downwardly swinging secondary tail plate by an extension portion formed on the top thereof to provide effective restoring forces.

3. The stretcher structure as claimed in claim 1 wherein said connection block having a tubular tail end that receives and holds the inner end of said secondary tail plate.

4. The stretcher structure as claimed in claim 3 wherein said connection block is provided on the inner end thereof with a downwardly extending portion that presses against said main stretcher to provide effective restoring forces when the umbrella endures wind blowing.

* * * * *